US009502808B1

(12) United States Patent
Baldwin et al.

(10) Patent No.: US 9,502,808 B1
(45) Date of Patent: Nov. 22, 2016

(54) LINEAR LOCKING ELECTRICAL DEVICE

(71) Applicants: Jeffrey Baldwin, Desert Hills, AZ (US); Ryan Liebengood, Gilbert, AZ (US)

(72) Inventors: Jeffrey Baldwin, Desert Hills, AZ (US); Ryan Liebengood, Gilbert, AZ (US)

( * ) Notice: Subject to any disclaimer, the term of this patent is extended or adjusted under 35 U.S.C. 154(b) by 0 days.

(21) Appl. No.: 14/694,395

(22) Filed: Apr. 23, 2015

Related U.S. Application Data

(60) Provisional application No. 61/984,042, filed on Apr. 25, 2014, provisional application No. 61/984,261, filed on Apr. 25, 2014, provisional application No. 61/987,400, filed on May 1, 2014, provisional application No. 61/987,403, filed on May 1, 2014, provisional application No. 61/987,409, filed on May 1, 2014, provisional application No. 61/988,256, filed on May 4, 2014, provisional application No. 61/991,590, filed on May 11, 2014, provisional application No. 62/047,022, filed on Sep. 7, 2014, provisional application No. 62/104,832, filed on Jan. 18, 2015.

(51) Int. Cl.
*H01R 4/50* (2006.01)
*H01R 13/453* (2006.01)

(52) U.S. Cl.
CPC ..... *H01R 13/4538* (2013.01)

(58) Field of Classification Search
CPC ..... H01R 13/447; H01R 13/4538; H01R 2103/00; H01R 13/193; H01R 13/20; H01R 23/025; H01R 13/7036; H02G 3/14
USPC ..... 439/135, 140, 188, 263, 346, 536; 174/66; 200/51.09
See application file for complete search history.

(56) References Cited

U.S. PATENT DOCUMENTS 4,600,258 A * 7/1986 Hu ..... H01R 13/447 439/135
4,909,749 A * 3/1990 Long ..... H01R 13/639 439/263
5,277,602 A * 1/1994 Yi ..... H01R 13/7036 439/138
5,551,884 A * 9/1996 Burkhart, Sr. ..... H01R 13/20 439/140
5,791,931 A * 8/1998 Burkhart, Sr. ..... H01R 13/20 439/304
6,193,539 B1 * 2/2001 Chang ..... H01R 13/6278 439/346
6,196,851 B1 3/2001 Gerard et al.
6,461,176 B1 * 10/2002 Haas ..... H01R 31/065 439/133
6,893,275 B2 * 5/2005 Ng et al. ..... H01R 13/4534 439/137
7,041,918 B1 * 5/2006 Wu ..... H01R 13/703 200/51.09
7,121,834 B2 10/2006 Gerard
7,125,256 B2 10/2006 Gerard
7,238,028 B2 7/2007 Gerard
7,753,682 B2 7/2010 Gerard
7,794,283 B2 * 9/2010 Wang ..... H01R 13/447 439/651
7,902,458 B2 3/2011 Eshelman
7,931,484 B2 * 4/2011 Chen ..... H01R 13/20 439/188
7,967,620 B1 6/2011 Baldwin et al.
8,007,283 B2 8/2011 Gerard
8,210,853 B2 7/2012 Gerard
8,344,251 B2 1/2013 Eshelman
8,475,175 B2 7/2013 Gerard
8,840,418 B2 * 9/2014 Chien ..... H01R 13/6392 439/270

* cited by examiner

*Primary Examiner* — Thanh Tam Le
(74) *Attorney, Agent, or Firm* — Ryan Liebengood

(57) ABSTRACT

An electrical receptacle including a body having a plurality of electrical connections a device face connected to the body, wherein the device face is slidable with respect to the body. An electrical device including a body having a face, a locking mechanism positioned within the body, and wherein the locking mechanism interacts with an electrical plug when the face is slide to a locked position.

15 Claims, 16 Drawing Sheets

LINEAR LOCKING ELECTRICAL DEVICE

CROSS-REFERENCE TO RELATED APPLICATIONS

This application claims priority to Provisional U.S. Patent Application No. 61/987,400, filed on May 1, 2014 and titled LINEAR LOCKABLE ELECTRICAL DEVICE to Baldwin et al., the disclosure of which is hereby incorporated herein by reference. This application claims priority to Provisional U.S. Patent Application No. 61/987,409, filed on May 1, 2014 and titled LOCKABLE ELECTRICAL DEVICE WITH BUTTON RELEASE to Baldwin et al., the disclosure of which is hereby incorporated herein by reference. This application claims priority to Provisional U.S. Patent Application No. 61/984,042, filed on Apr. 25, 2014 and titled LOCKABLE ELECTRICAL DEVICE to Baldwin et al., the disclosure of which is hereby incorporated herein by reference. This application claims priority to Provisional U.S. Patent Application No. 61/984,261, filed on Apr. 25, 2014 and titled WEATHERPROOF SELF-SECURING ELECTRICAL RECEPTACLE to Baldwin et al., the disclosure of which is hereby incorporated herein by reference. This application claims priority to Provisional U.S. Patent Application No. 61/987,403, filed on May 1, 2014 and titled INWARD LOCKABLE ELECTRICAL DEVICE to Baldwin et al., the disclosure of which is hereby incorporated herein by reference. This application claims priority to Provisional U.S. Patent Application No. 61/988,256, filed on May 4, 2014 and titled CAM ENGAGEMENT ROTATABLE DEVICE to Baldwin et al., the disclosure of which is hereby incorporated herein by reference. This application claims priority to Provisional U.S. Patent Application No. 61/991,590, filed on May 11, 2014 and titled LOCKING ROTATABLE DEVICE AND CORD LOCK to Baldwin et al., the disclosure of which is hereby incorporated herein by reference. This application claims priority to Provisional U.S. Patent Application No. 62/047,022, filed on Sep. 7, 2014 and titled WATER RESISTANT CORD END to Baldwin et al., the disclosure of which is hereby incorporated herein by reference. This application claims priority to Provisional U.S. Patent Application No. 62/104,832, filed on Jan. 18, 2015 and titled ELECTRICALLY ISOLATED RECEPTACLE to Baldwin et al., the disclosure of which is hereby incorporated herein by reference. This application hereby incorporates by reference co-filed applications titled LOCKING ELECTRICAL DEVICE and ROTATING ELECTRICAL DEVICE both to Baldwin et al. and filed on the same day as this application.

BACKGROUND

Electrical devices and receptacles are well known to provide electrical current to a number of devices within a building once connected to the electrical receptacle. Some features of electrical devices include tamper resistant shutters to prevent inappropriate access to the device and to make sure the electrical device is as safe as possible.

SUMMARY

Aspects of this disclosure relate to an electrical receptacle. The electrical receptacle may include a body having a plurality of electrical connections, a device face connected to the body, and wherein the device face is slidable with respect to the body.

In an implementation, a plurality of electrical receptacle apertures may be located on the device face. The slidable movement may be in the vertical direction. The slidable movement may be in the horizontal direction. The body may further include at least one locking prong which is engaged when the device face is slide to a locked position. The locking prong may extend inward when the device face is moved to the locked position. The body may further include at least one ramp which operates in conjunction with the at least one locking prong. The at least one ramp may be two ramps. The at least two ramps may be angled towards each other. The body may further include at least one spring biased member which prevents sliding movement unless an electrical plug is fully inserted into the receptacle.

An electrical plug may not be removable when the electrical receptacle is moved to the locked position. The at least one prong may be positioned within at least one aperture in the electrical plug when the device face is moved to a locked position. The device face may be at least two device faces which are slidable independent of each other. A release button may be included which can be engaged to slide the device face from a locked position to an unlocked position. A removal force between 20 to 50 pounds removes an electrical plug from the electrical receptacle when the device face is in a locked position. A removal force between 32 and 40 pounds removes an electrical plug from the electrical receptacle when the device face is in a locked position.

In another aspect, the electrical device may include a body having a face, a locking mechanism positioned within the body, and wherein the locking mechanism interacts with an electrical plug when the face is slide to a locked position.

In an implementation, the face may be slidable in the vertical direction. The locking mechanism may be at least one pivotable component with a tab. The locking mechanism may be two pivotable components each having a tab. The two pivotable components may each engage with separate ramps in the body.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Embodiments of the present invention will hereinafter be described in conjunction with the appended drawings, where like designations denote like elements, and.

DETAILED DESCRIPTION

Figure 1:
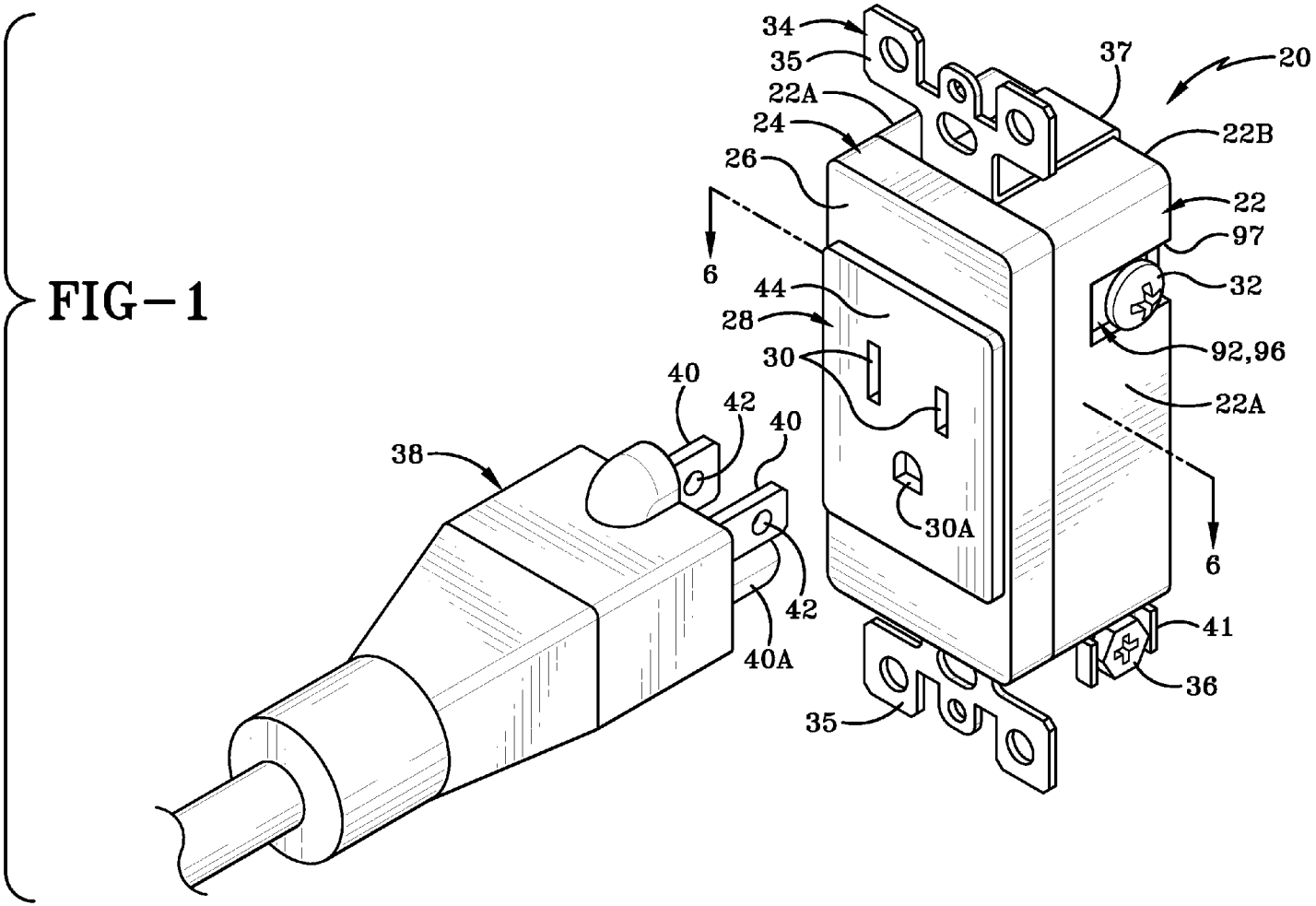
FIG. 1 is a perspective view of a linear electrical receptacle with an electrical plug separated.
Figure 2A:
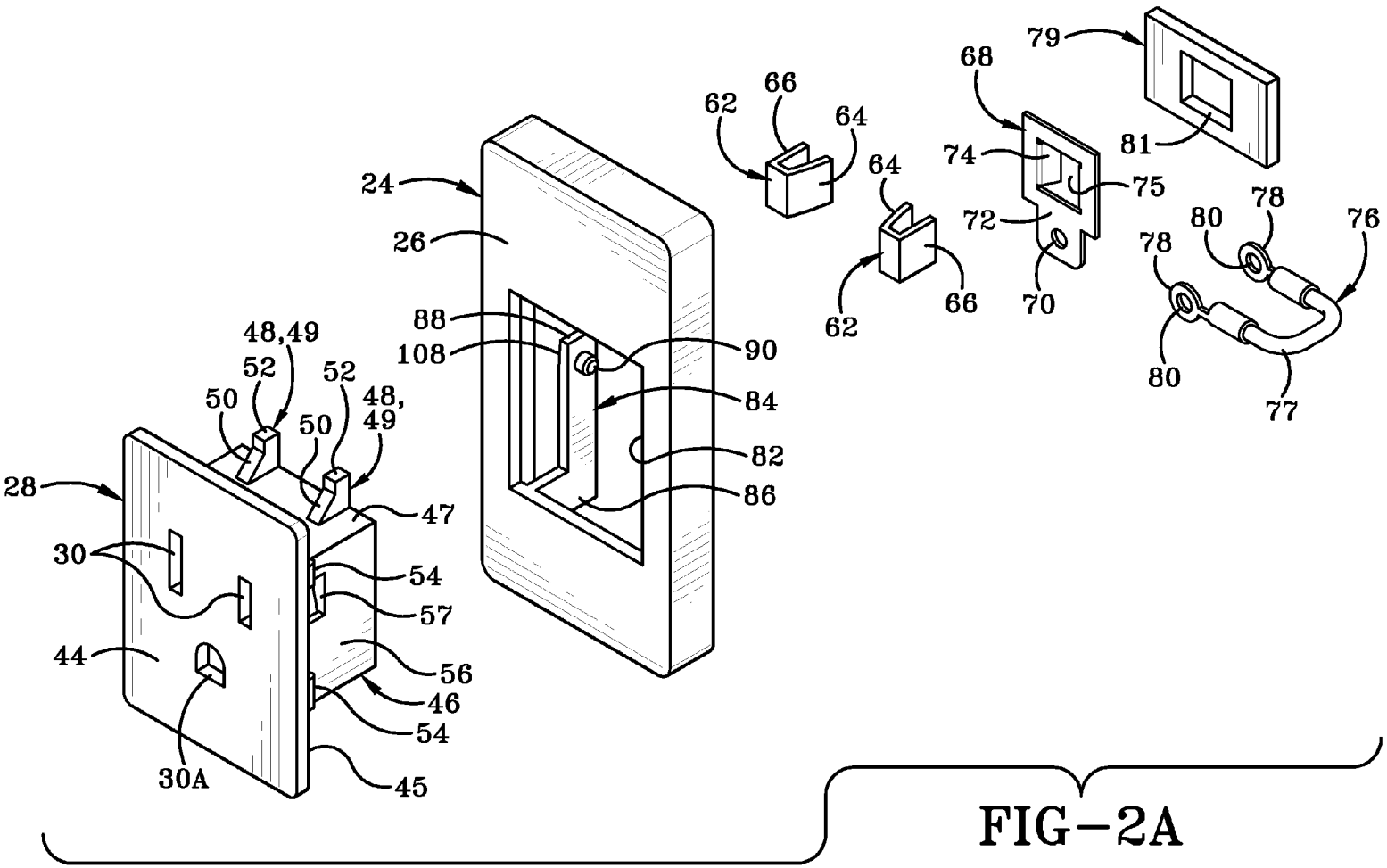
FIG. 2A is a perspective view of some internal components of the linear electrical receptacle.
Figure 2B:
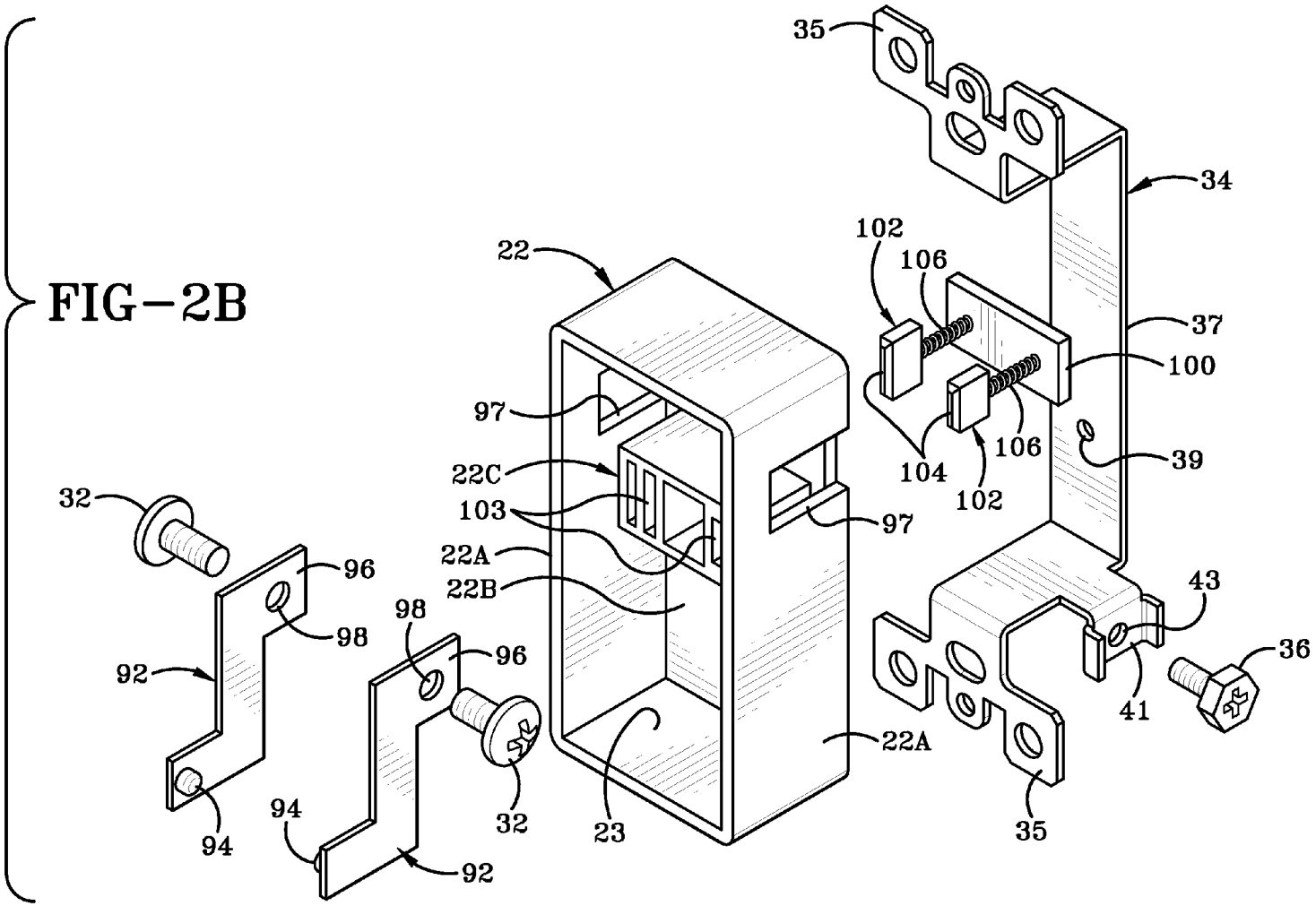
FIG. 2B is a perspective view of some internal components of the linear electrical receptacle.
Figure 3:
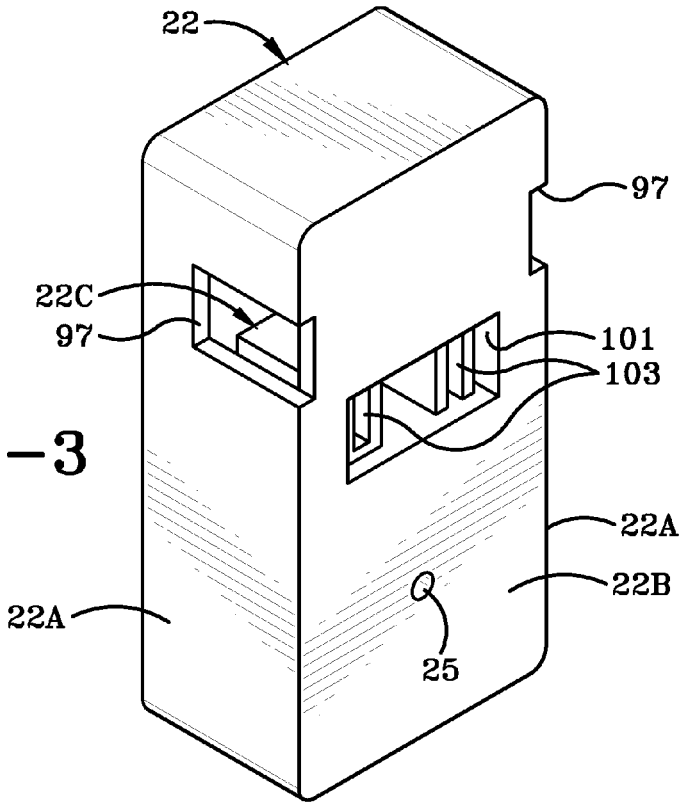
FIG. 3 is a rear perspective view of the body of the linear electrical receptacle.

This disclosure, its aspects and implementations, are not limited to the specific components or assembly procedures disclosed herein. Many additional components and assembly procedures known in the art consistent with the intended operation and assembly procedures for an electrical receptacle will become apparent for use with implementations of an electrical receptacle from this disclosure. Accordingly, for example, although particular components are disclosed, such components and other implementing components may comprise any shape, size, style, type, model, version, measurement, concentration, material, quantity, and/or the like as is known in the art for such implementing components, consistent with the intended operation of an electrical receptacle.

FIGS. 1-5 illustrate various views of electrical receptacle 20. Electrical receptacle 20 includes a rear body 22 with sidewalls 22A and back wall 22B. A front body 24 which may be a separate piece from rear body 22 and they may be connected together while front body 24 includes a front surface 26. A tamper resistant tab mounting structure 22C may extend forward from and be formed in part from back wall 22B. A device face 28 is positioned on front surface 26 and includes a plurality of receptacle openings 30 and ground prong opening(s) 30A. Electrical receptacle 20 may also include electrical connection screws 32, yoke 34, and grounding screw 36 as is commonly known in the electrical receptacle art. Grounding screw 36 may be positioned on a ground wire connection tab 41 having a hole 43, while connection screws 32 may be positioned in apertures 97 in sidewalls 22A of rear body 22 for accessing receiving arms 96 of connectors 92 while in rear body chamber 23. Yoke 34 may include mounting flanges 35 on each end with a vertical portion 37 having a hole 39 therein which is positioned to mount the yoke to rear body 22 at hole 25 in the rear body back wall 22B.

Referring to FIG. 1, an electrical plug 38 is shown separated from electrical receptacle 20. Electrical plug 38 may include plug blades 40 and ground prong 40A extending therefrom and having apertures 42 in the plug blades. While a 3 prong electrical plug and plug blades is shown, it is within the spirit and scope of the present disclosure to incorporate a two prong electrical plug or any other suitable numbers of prongs.

Device face 28 may include a device face surface 44 and a rear surface 45 with a device face 28 rear portion 46 having a top surface 47. Tabs 48 extend from top surface 47 and may include angled surface 50, top surface 52, and rear surfaces 49. Device face 28 includes retainer tabs 54 used to secure the device face with front body 24 having a back surface 27. Rear portion walls 56 may include ramped portions 58 and form a cavity 60 for receiving locking arms therein. The rear portion walls 56 may include apertures 57 for contact mechanisms 62 to be accessible.

Each contact mechanisms 62 may include inner contact surfaces 64 and outer contact surfaces 66 which are adapted to convey electrical current from the electrical connections to the electrical plug when inserted. A ground tab 68 may include a mounting hole 70 and a ground tab body 72 having ground angled walls 74 therein for securely retaining an electrical plug ground prong within aperture 75. A ground connector 76 may include a washer and crimp 78 on each end of wire 77 with apertures 80 therein. A ground support 79 includes an aperture 81 and is used in conjunction with ground tab 68 and ground connector 76 to further secure and retain the ground prong. A rivet 130 may be used to secure ground connector 76 to ground tab 68 and yoke mount strip 37 to back wall 22B. Front body 24 may also include a front body opening 82 with locking arms 84 positioned behind a front surface 26. Locking arms 84 may include offset portions 86 and ends 88 with a locking arm prong 90 near end 88.

Connectors 92 may include connector protrusions 94 on a first end and connector arms 96 with connector apertures 98 therein. Connector apertures 98 may be threaded and arranged to receive electrical connection screws 32. A block 100 includes tamper resistant tabs 102 which include angled front faces 104 and are connected to block 100 with springs 106. Apertures 101 in back wall 22B communicate with channels 103 in mounting structure 22C. Tamper resistant tabs 102 are used to prevent the sliding motion without an electrical plug engaged as will be discussed in greater detail below.

Figure 4:
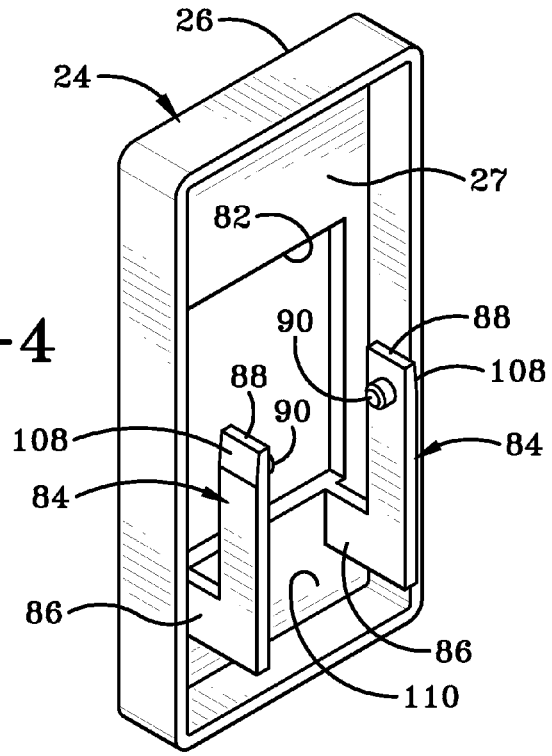
FIG. 4 is a rear perspective view of the front body of the linear electrical receptacle.
Figure 5:
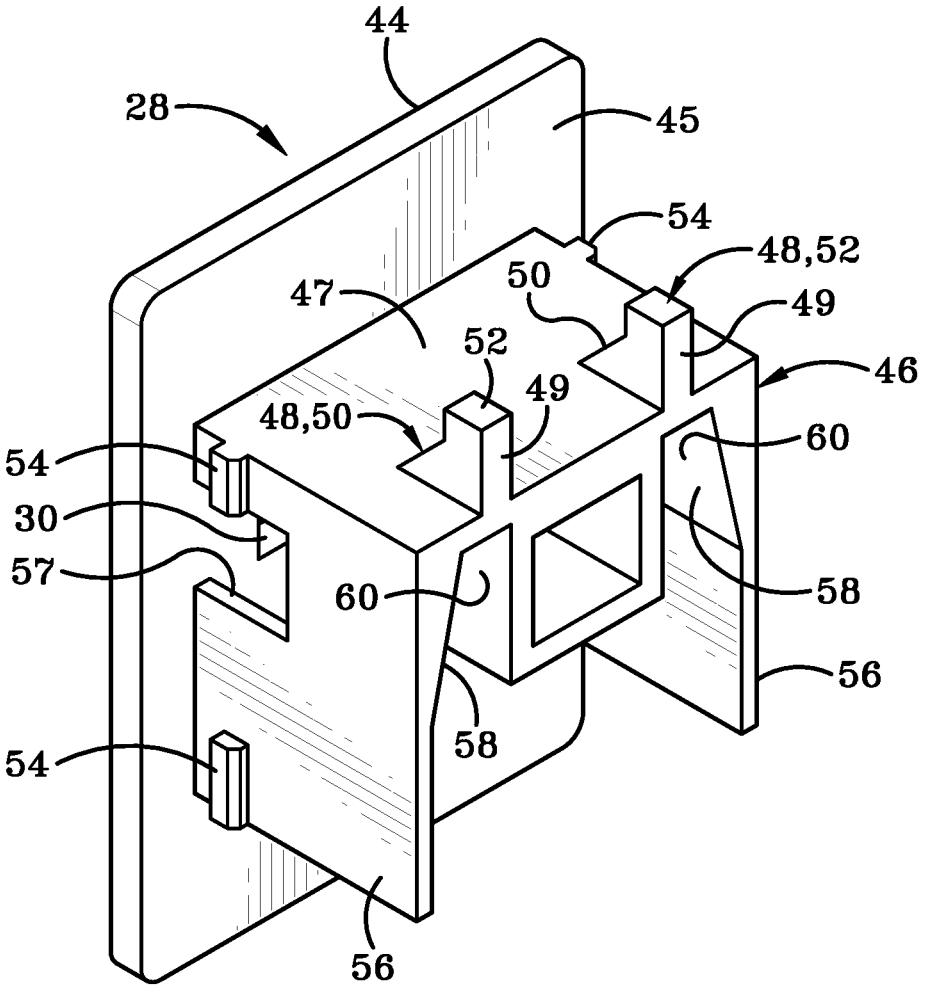
FIG. 5 is a rear perspective view of a device face.

FIG. 4 illustrates a back perspective view of body front 24 which highlights locking arm 84 within body front cavity 110. Locking arm 84 may include ramped surfaces 108 on an outer portion of the locking arm ends 88. In this orientation, ramped surfaces 108 assist with deflecting the locking arm ends 88 inwards as will be discussed in greater detail.

Figure 6:
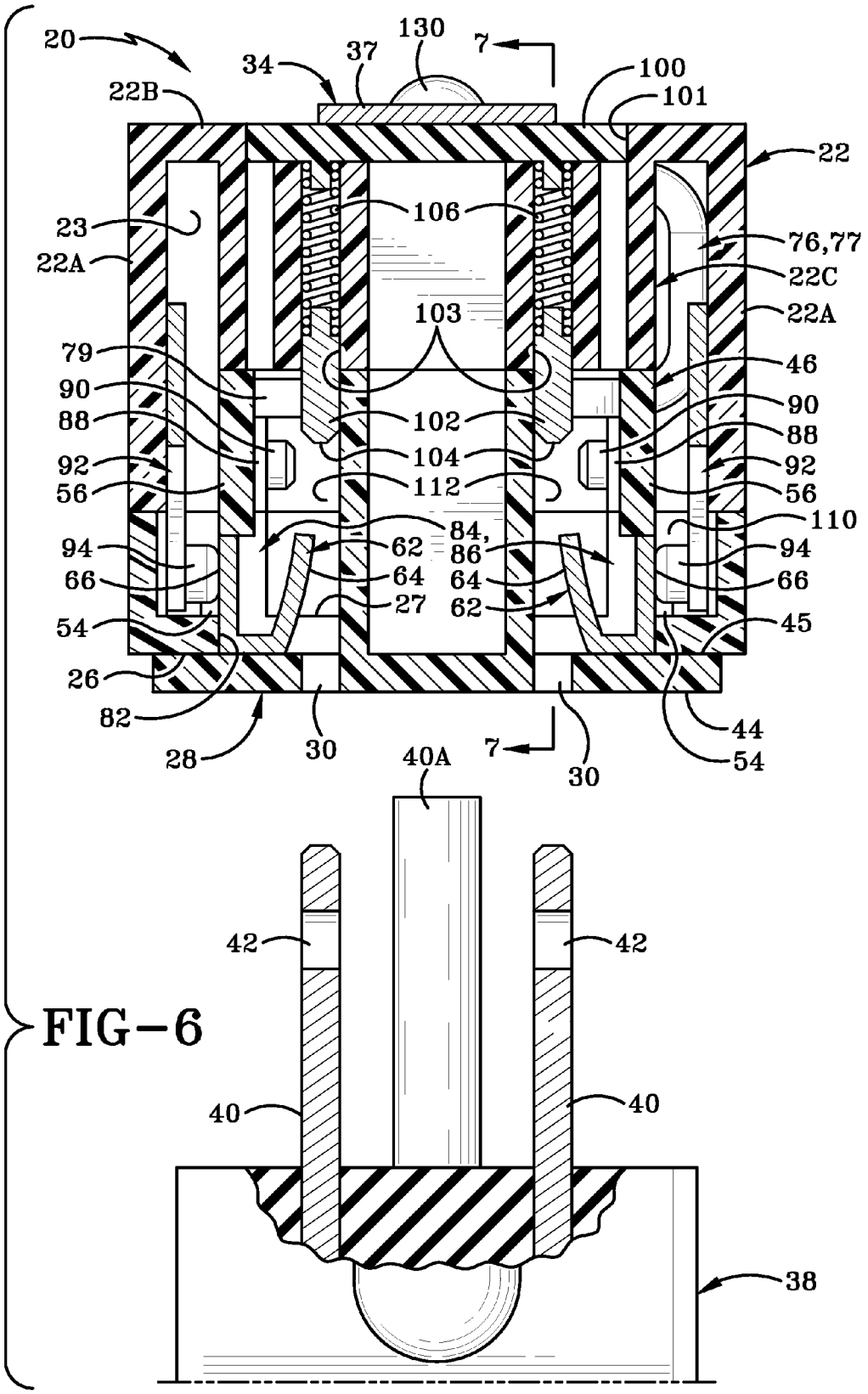
FIG. 6 is a partial sectional view taken generally about line 6-6 in FIG. 1.

FIG. 6 illustrates a pair of receptacle blade cavities 112 formed by contact mechanism 62, locking arm 84, device face rear portion walls 56. Receptacle blade cavities 112 may also be slightly increased or decreased, depending on the configuration, by compressing springs 106 and moving tamper resistant tabs 102 with electrical plug blades 40 during insertion or decompressing springs 106 and moving tamper resistant tabs 102 when electrical plug blades 40 are removed.

Figure 7:
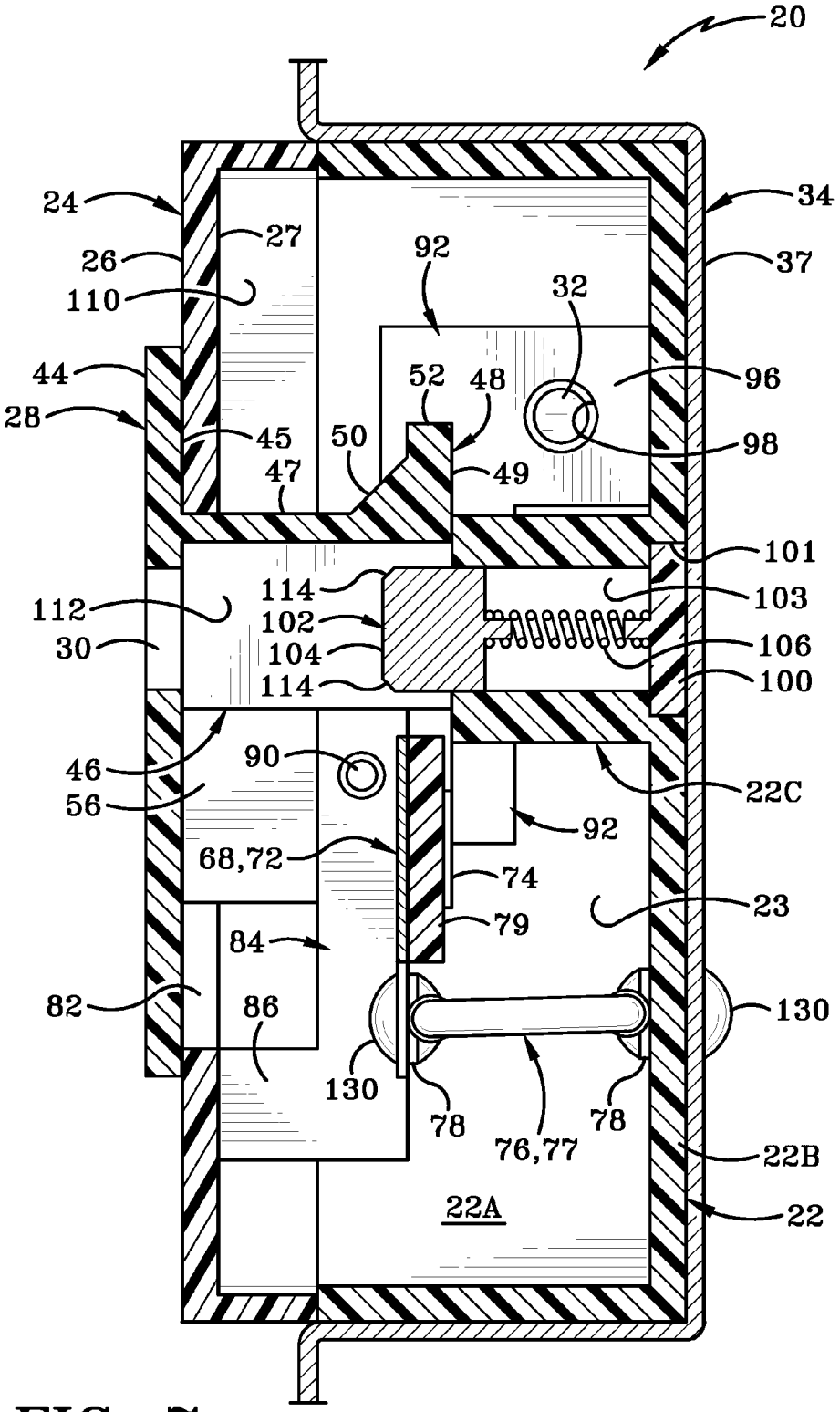
FIG. 7 is a sectional view taken generally about line 7-7 in FIG. 6.
Figure 8:
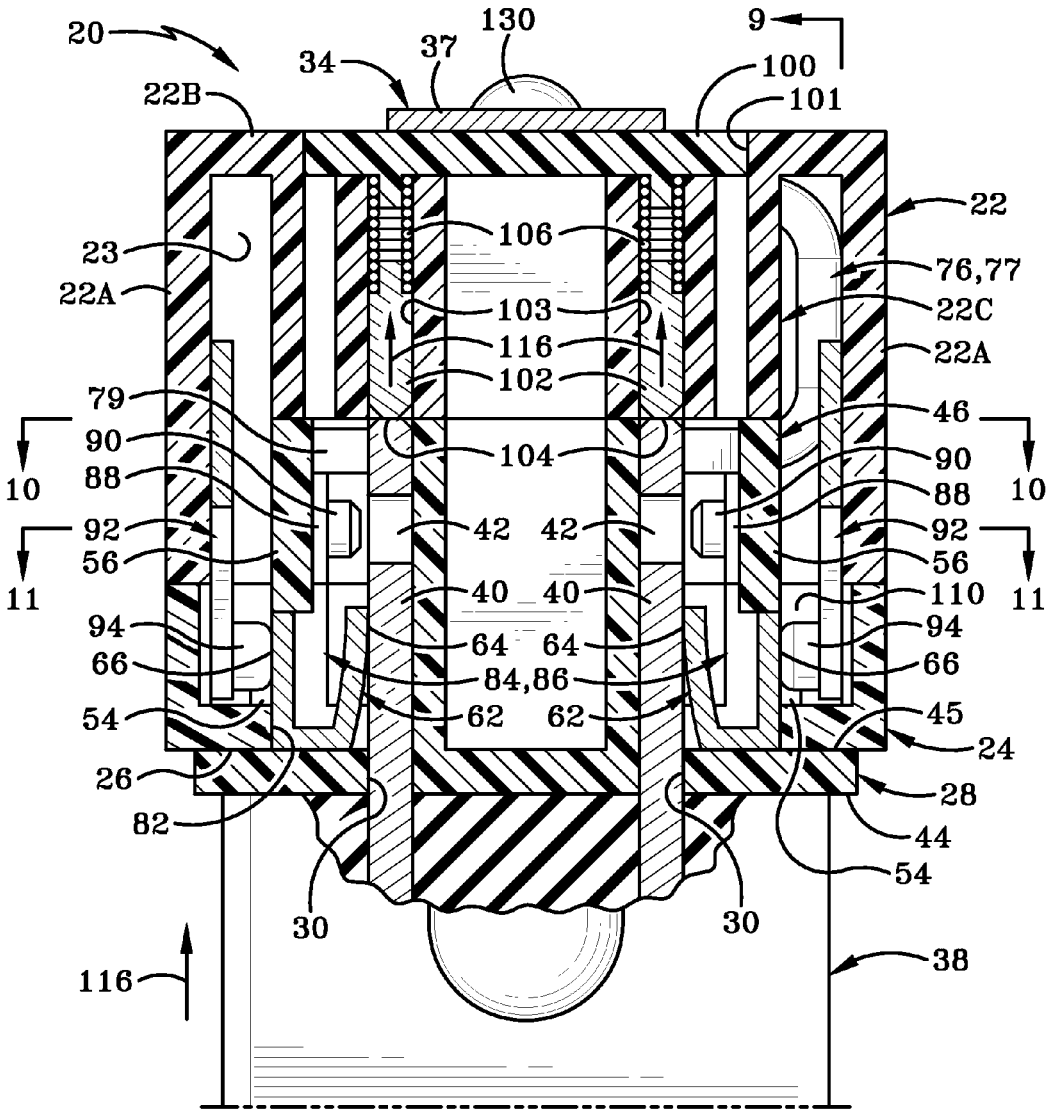
FIG. 8 is a partial sectional view taken generally about line 6-6 in FIG. 1 with an electrical plug inserted into the electrical receptacle.
Figure 9:
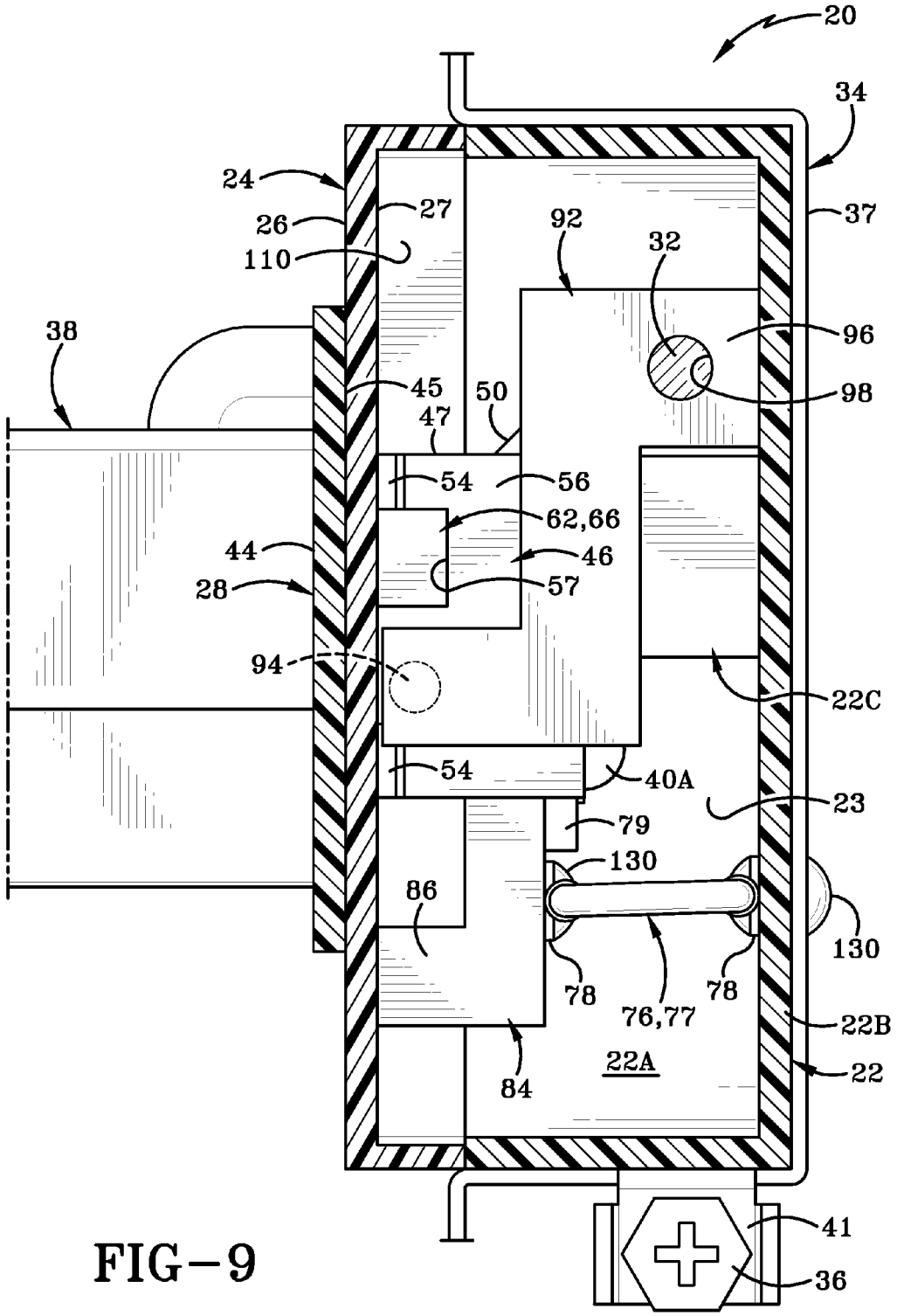
FIG. 9 is a sectional view taken generally about line 9-9 in FIG. 8.
Figure 10:
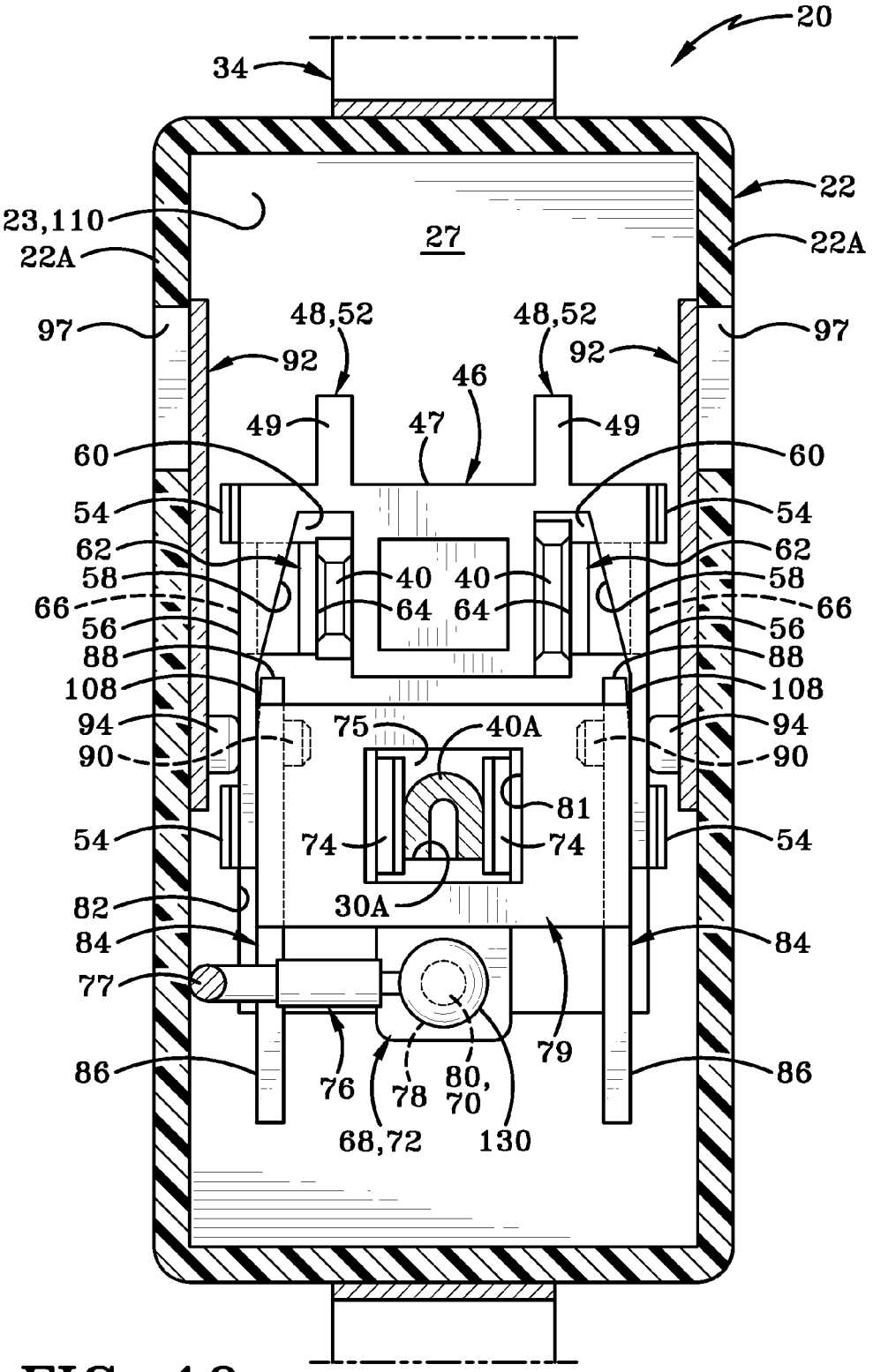
FIG. 10 is a sectional view taken generally about line 10-10 in FIG. 8.
Figure 11:
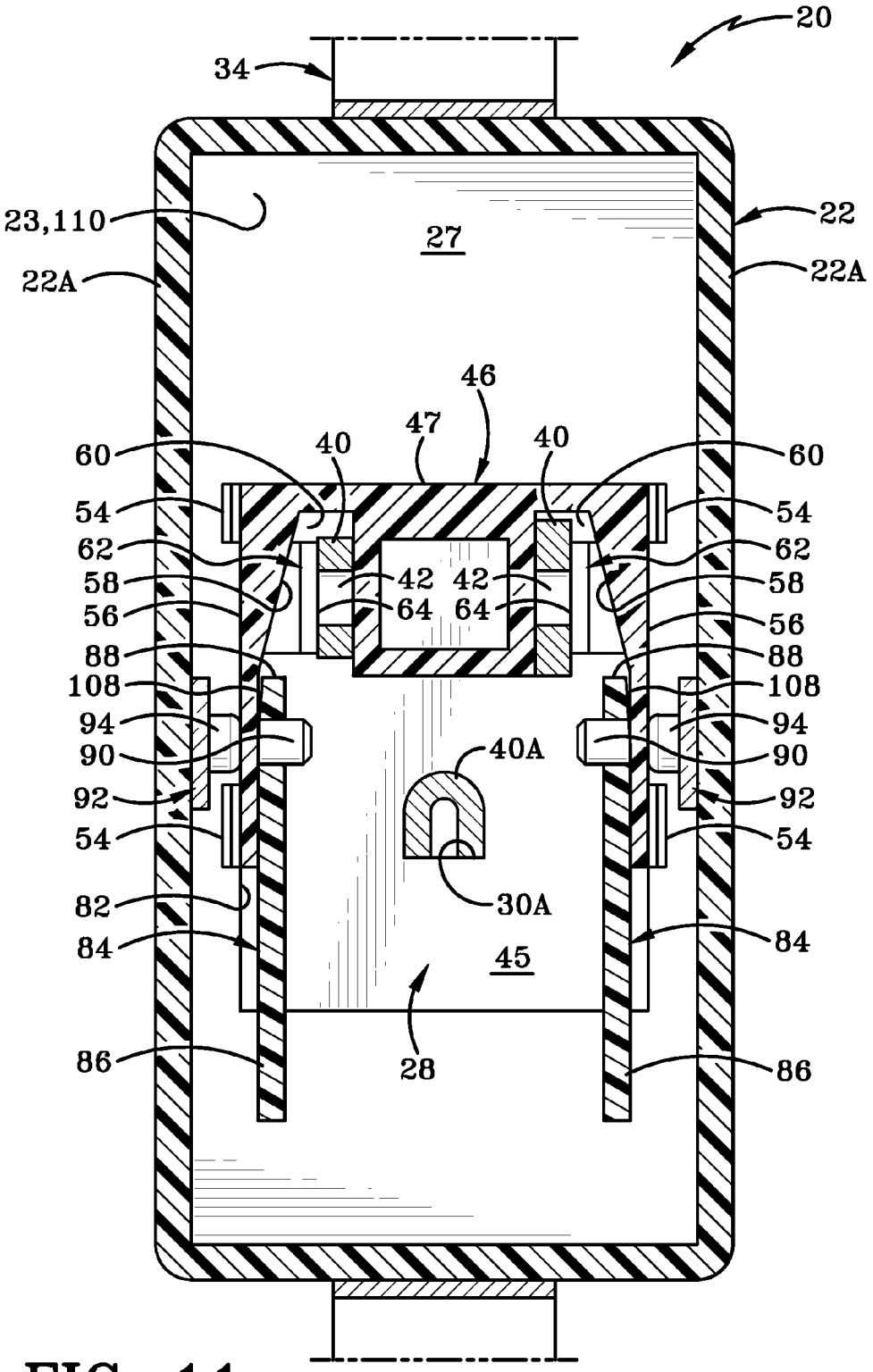
FIG. 11 is a sectional view taken generally about line 11-11 in FIG. 8.

FIG. 7 illustrates a side view of tamper resistant tabs 102 having clearance surfaces 114. Clearance surfaces 114 are used to permit and facilitate easier vertical movement of the device face. Specifically, clearance surface 114 are used as a chamfer which allows the tamper resistant tabs to engage and disengage the device face and permit movement in both the upwards and downwards direction.

Figure 12:
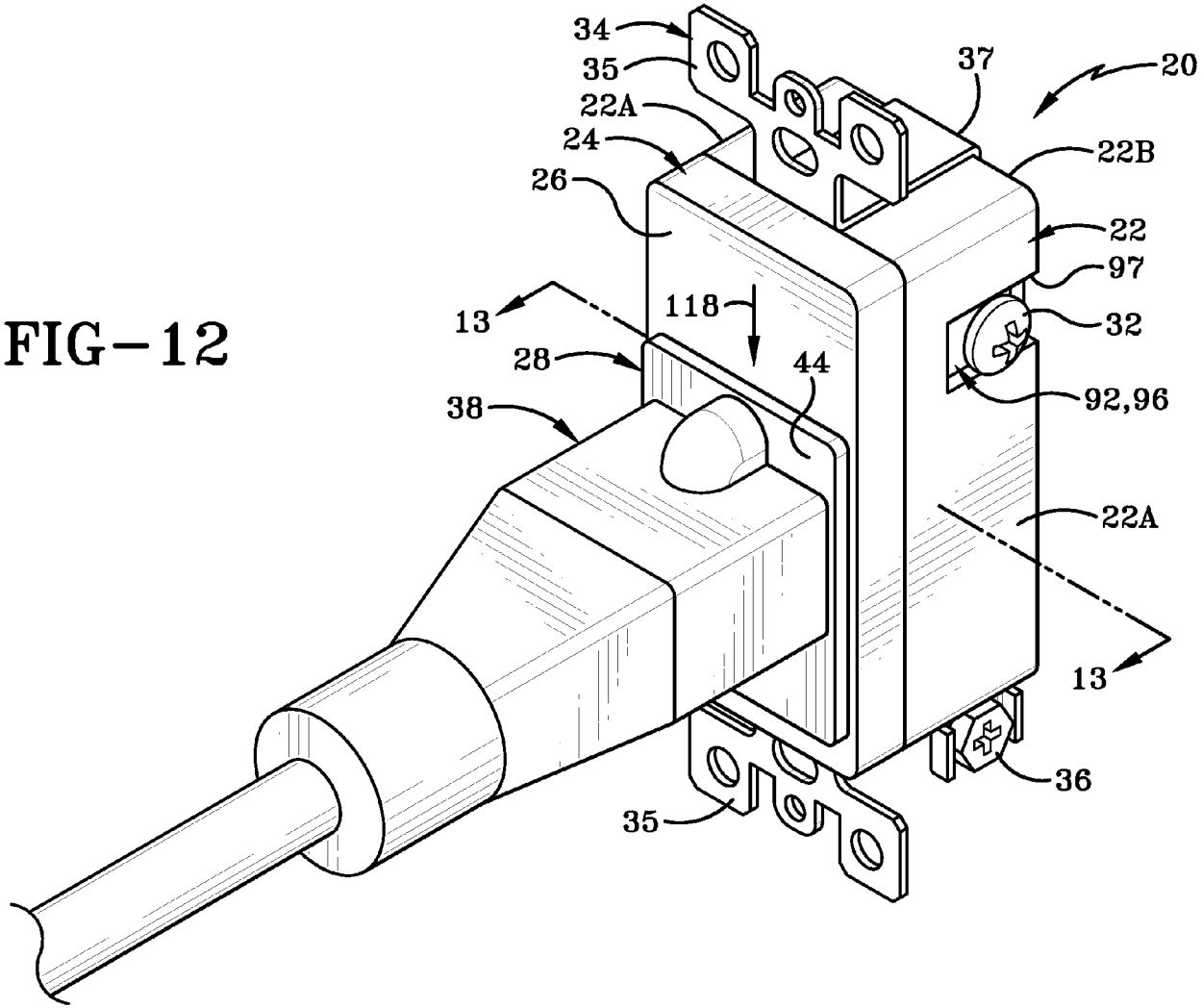
FIG. 12 is a perspective view of the electrical receptacle with an electrical plug inserted.
Figure 13:
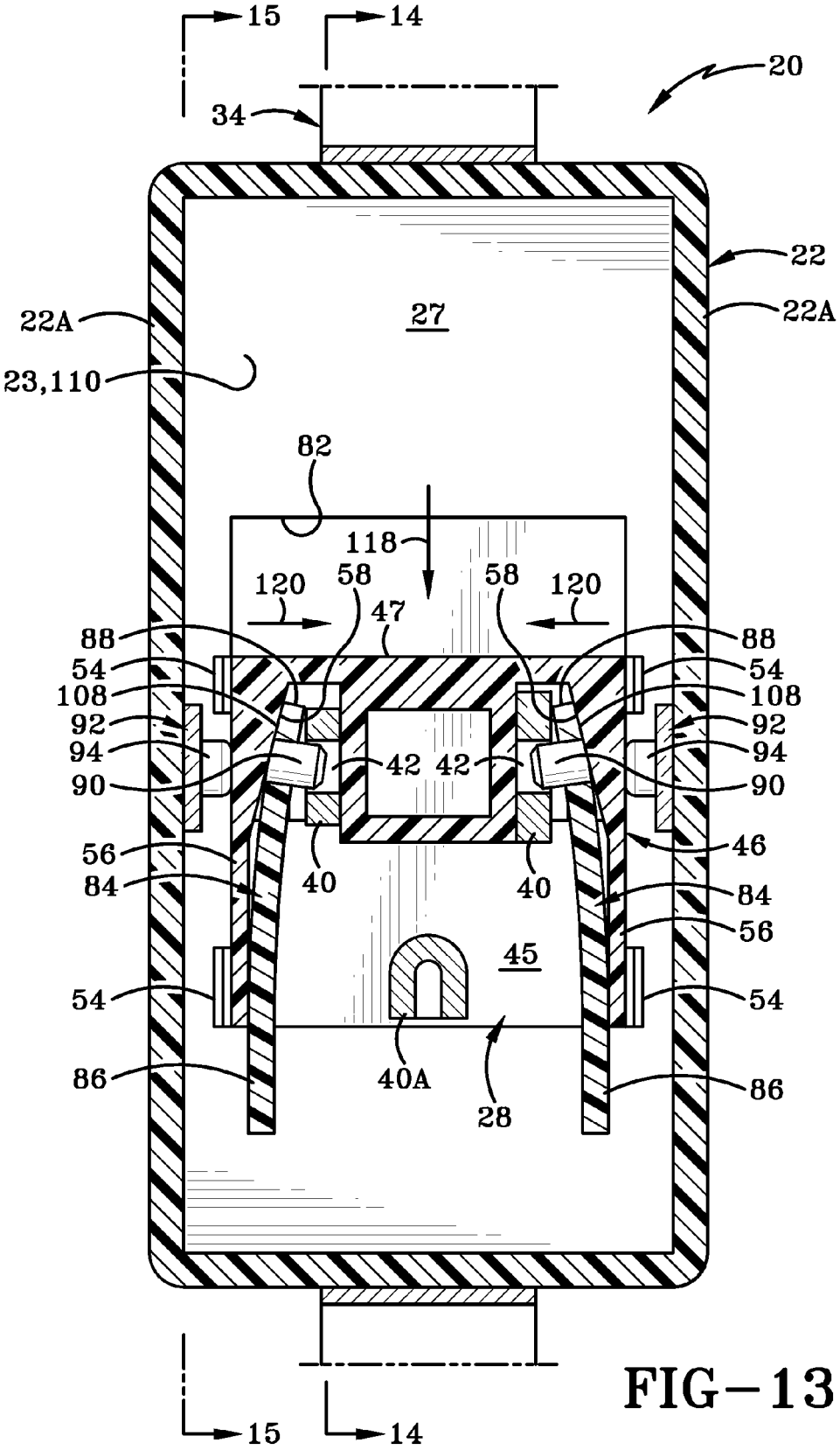
FIG. 13 is a sectional view of the electrical receptacle taken generally about line 13-13 in FIG. 12.
Figure 14:
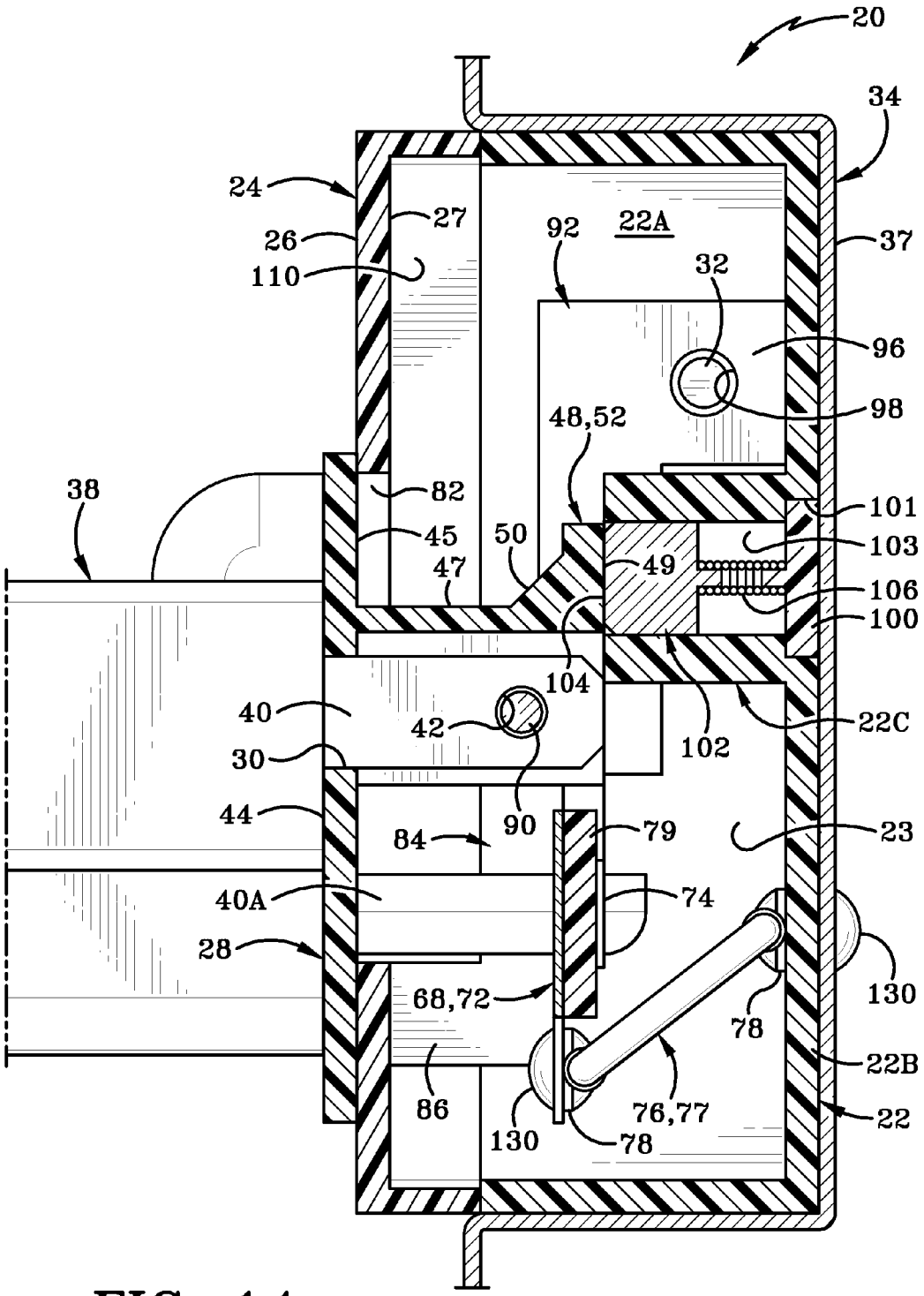
FIG. 14 is a sectional view of the electrical receptacle taken generally about line 14-14 in FIG. 13.
Figure 15:
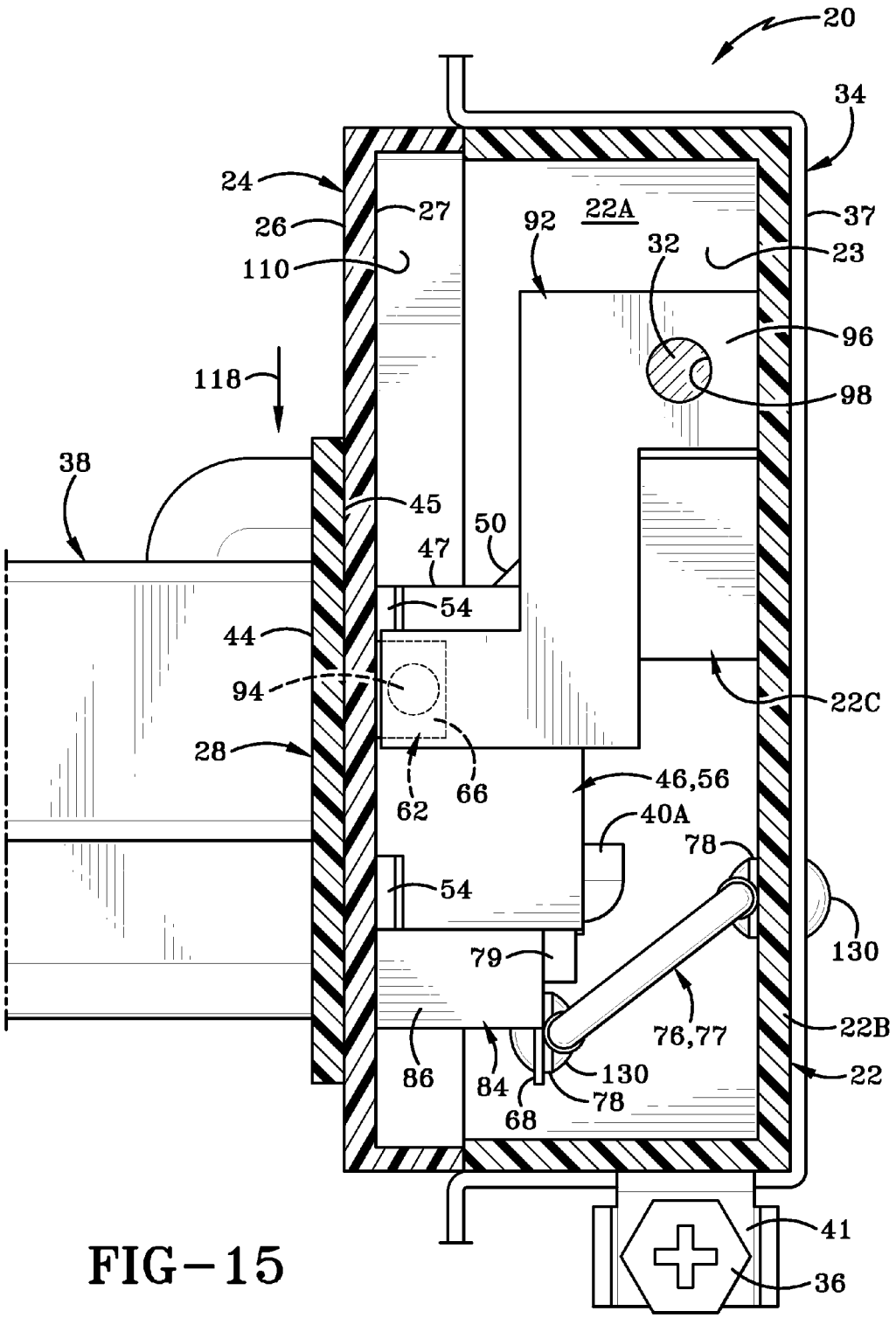
FIG. 15 is a sectional view of the electrical receptacle taken generally about line 15-15 in FIG. 13.

FIGS. 8-15 illustrate various operational views of the electrical device. FIGS. 8-11 illustrate various views of the electrical plug 38 with plug blades 40 inserted through device face 28 and receptacle openings 30. Specifically, plug blades 40 are inserted in the direction associated with arrow 116. With movement in the direction of arrow 116, plug blades 40 also contact tamper resistant tabs 102 and compress springs 106 until the tamper resistant tabs 102 extend beyond a rear surface of device face rear portion 46. When the tamper resistant tabs 102 are forced behind device face rear portion 46, device face 28 may be moved linearly in the direction associated with arrows 118 as seen in FIG. 12.

FIGS. 12-15 illustrate the next movement of the device face 28 and the electrical receptacle in general after an electrical plug is fully inserted through receptacle openings 30. Specifically, the electrical plug and device face 28 are moved in the direction associated with arrow 118 so that they both move relative to body front 24. Movement of device face 28 in the direction of arrow 118 forces device face 28 and particularly rear portion walls 56 downward onto locking arms 84. Rear portion walls 56 and specifically ramped portions 58 communicate with the locking arms and specifically locking arm end 88 with locking arm ramped surface 108 which are received within cavities 60. When ramped surfaces 108 contact ramped portions 58, the locking arm end 88 and locking arm prong 90 are forced in the direction associated with arrows 120. Since electrical plug blades 40 are positioned within the electrical receptacle 20, locking arm prongs 90 are positioned within blade apertures 42. With the locking arm prongs 90 within blade apertures 42, the electrical plug blades 40 and the electrical plug 38 cannot be pulled outwards easily.

In another implementation, the electrical plug 38 may be removed after a specified amount of force, such as 50 pounds of pulling force overcoming the locking arm prongs 90 and thereby permitting the electrical plug to be removed without inadvertently dislodging the electrical receptacle. In yet another implementation, the electrical plug may only be removed when the locking arm prongs 90 are disengaged from blade apertures 90. Specifically, the electrical plug is removable from the electrical device with less than 15 pounds of removal force in the unlocked position and in one implementation between 3 to 15 pounds of force removes the plug as identified in UL498. In another implementation, the removal force in the unlocked removable force is between 0 and 30 pounds of removal force.

In the locked position, the removal force may be higher. The removal force in the locked position may be between 32 and 38 pounds of removal force or between 25 and 50 pounds of removal force in another implementation. As can be seen, any suitable holding force may be utilized in the locked position between 25 to 50 plus pounds of force as the electrical code, UL, and various requirements may specify. In another implementation, the removal force may be less than 20 or 15 pounds. Accordingly, any suitable unlocked and locked force may be utilized to secure the electrical cord within the receptacle. While the above description relates to a three prong electrical plug, a similar analysis may be accomplished for a two prong electrical plug whereby the two prong electrical plug may have higher or lower removal force in the locked or unlocked positions selectively between 0 and 50 plus pounds.

In order to remove the electrical plug 38, the user simply slides the device face upwards to allow the locking arm ends 88 to move outwards against the ramped portions 58 to remove locking arm prongs 90 from plug apertures 42. The additional movement upwards moves the device away from the locking prongs. The user may then remove the electrical plug blades 40 and tamper resistant tabs 102 may be repositioned by springs 106 to prevent unwanted access to the electrical device.

In another aspect, the electrical receptacle 20 may include an electrical current control or cutoff circuit. In this instance, the electrical contact mechanisms may be electrically isolated from the electrical connection screws and other line voltage until the electrical receptacle is slide to the active, engaged, or locked position.

In another aspect, a person of skill in the art will immediately appreciate that the sliding electrical face may be duplicated to provide more than one sliding face on the electrical device. For example, two sliding faces may move vertically together or independently. Further, the two sliding faces may slide horizontally in the same or different directions. Still further, one sliding face could move vertically while the other sliding face could move horizontally. Any number of sliding faces may be utilized and slide in any suitable direction without departing from the spirit and scope of the present disclosure. While not specifically shown, the same features may be implemented in any suitable electrical receptacle, whether on a power strip, surge protector, cord reel, power tap, extension cords, or the like.

Figure 16:
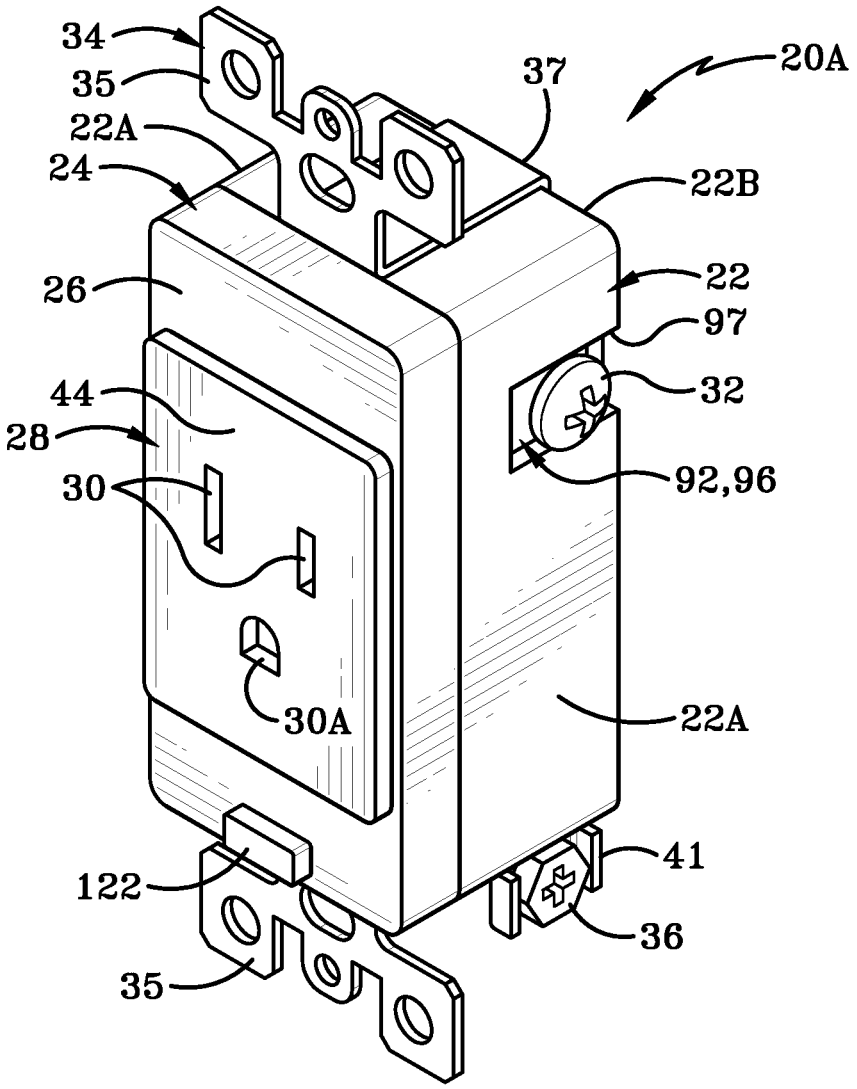
FIG. 16 is a perspective view of an electrical receptacle with a release button.

FIG. 16 illustrates another implementation electrical receptacle 20A with a lock and release button 122. The electrical receptacle is moveable in a manner similar to the above-referenced disclosure but may lock in the engaged, active, or locked position. Accordingly the electrical receptacle remains locked until release button 122 is depressed, thereby allowing the device face 28 to be moved upwards or into the unlocked position. In another implementation, device face 28 may be spring biased to the unlocked or upwards position such that when the spring is compressed or extended by moving to the locked position, the device face will return to its natural position and force the device face to the unlocked position.

It will be understood that implementations are not limited to the specific components disclosed herein, as virtually any components consistent with the intended operation of a method and/or system implementation for an electrical receptacle may be utilized. Components may comprise any shape, size, style, type, model, version, class, grade, measurement, concentration, material, weight, quantity, and/or the like consistent with the intended operation of a method and/or system implementation for an electrical receptacle.

While this and other embodiments illustrate the use of a side-wired receptacle, a person of skill in the art will immediately appreciate that a back wired, side wired, hard wired, or any other suitable connection method to the structural wiring system may be utilized without departing from the spirit and scope of the present disclosure.

The concepts disclosed herein are not limited to the specific implementations shown herein. For example, it is specifically contemplated that the components included in a particular implementation of an electrical receptacle may be formed of any of many different types of materials or combinations that can readily be formed into shaped objects and that are consistent with the intended operation of an electrical receptacle. For example, the components may be formed of: rubbers (synthetic and/or natural) and/or other like materials; polymers and/or other like materials; plastics, and/or other like materials; composites and/or other like materials; metals and/or other like materials; alloys and/or other like materials; and/or any combination of the foregoing.

Furthermore, embodiments of the electrical receptacle may be manufactured separately and then assembled together, or any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled or removably coupled with one another in any manner, such as with adhesive, a weld, a fastener, any combination thereof, and/or the like for example, depending on, among other considerations, the particular material(s) forming the components.

In places where the description above refers to particular implementations of an electrical receptacle, it should be readily apparent that a number of modifications may be made without departing from the spirit thereof and that these implementations may be applied to other electrical receptacles. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

We claim:

1. An electrical receptacle comprising:

a body having a plurality of electrical connections and a front surface;

a device face connected to the body at the front surface; and, wherein the device face is slidable along the front surface of the body;

wherein the body further comprises at least one locking prong which is engaged with an electrical plug blade when the device face is slide to a locked position; and wherein the locking prong extends inward when the device face is moved to the locked position.

2. The electrical receptacle of claim 1 wherein a plurality of electrical receptacle apertures are located on the device face.

3. The electrical receptacle of claim 1 wherein the slidable movement is in the vertical direction.

4. The electrical receptacle of claim 1 wherein the slidable movement is in the horizontal direction.

5. The electrical receptacle of claim 1 wherein the body further comprises at least one ramp which operates in conjunction with the at least one locking prong.

6. The electrical receptacle of claim 5 wherein the at least one ramp is two ramps and one of the two ramps is on a first sidewall and the second of the two ramps is on a second sidewall.

7. The electrical receptacle of claim 6 wherein the at least two ramps are angled towards each other.

8. The electrical receptacle of claim 1 wherein the body further comprises at least one spring biased member which prevents sliding movement unless an electrical plug is fully inserted into the receptacle.

9. The electrical receptacle of claim 1 wherein the electrical plug blade cannot be removed when the electrical receptacle is moved to the locked position.

10. The electrical receptacle of claim 1 wherein the at least one locking prong is positioned within at least one aperture in the electrical plug blade when the device face is moved to a locked position.

11. The electrical receptacle of claim 1 wherein a removal force between 20 to 50 pounds removes an electrical plug from the electrical receptacle when the device face is in a locked position.

12. The electrical receptacle of claim 1 wherein a removal force between 32 and 40 pounds removes an electrical plug from the receptacle when the device face is in a locked position.

13. An electrical device comprising:

a body having a front surface and a separate face;

a locking mechanism positioned within the body; and, wherein the locking mechanism interacts with an electrical plug when the face is slide along the front surface to a locked position;

wherein the locking mechanism is two pivotable components each having a tab.

14. The electrical device of claim 13 wherein the face is slidable in the vertical direction.

15. The electrical device of claim 13 wherein the two pivotable components each engages with separate ramps in the body.

* * * * *